US006341968B1

(12) United States Patent
Grant

(10) Patent No.: US 6,341,968 B1
(45) Date of Patent: Jan. 29, 2002

(54) LEVER-TYPE CONNECTOR

(75) Inventor: Matthew Grant, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/579,017

(22) Filed: May 26, 2000

(30) Foreign Application Priority Data

Jun. 14, 1999 (JP) ..... 11-167347

(51) Int. Cl.[7] ..... H01R 13/62
(52) U.S. Cl. ..... 439/157
(58) Field of Search ..... 439/157, 372, 439/310

(56) References Cited

U.S. PATENT DOCUMENTS 5,427,540 A * 6/1995 Taguchi ..... 439/157
5,445,530 A * 8/1995 Inoue et al. ..... 439/157
5,476,390 A 12/1995 Taguchi et al.
5,484,297 A * 1/1996 Takahashi et al. ..... 439/157
5,531,605 A 7/1996 Taniuchi et al.
5,727,959 A * 3/1998 Yagi et al. ..... 439/157

FOREIGN PATENT DOCUMENTS

GB 2322242 8/1998
JP 10-334987 12/1998

* cited by examiner

*Primary Examiner*—Brian Sircus
*Assistant Examiner*—Brian S. Webb
(74) *Attorney, Agent, or Firm*—Banner & Witcoff, Ltd.

(57) ABSTRACT

A lever 23 of a lever connector is provided with an identifying means 31. When two housings 10 and 20 are in a shallowly fitted state, the identifying means 31 allows the positional relationship between the lever 23 and cam pins 14, relative to the direction of movement of the lever 23, to be identified visually. When the lever 23 is in a correct stand-by position, the cam pins 14 are entirely covered by a covering member 32. When the lever 23 is even slightly misaligned from the correct stand-by position, a portion of the cam pin 14 protrudes into an aperture 33. Thus, it is possible to ascertain whether the lever 23 is in the correct stand-by position according to whether the cam pins 14 are entirely covered.

8 Claims, 5 Drawing Sheets

LEVER-TYPE CONNECTOR

TECHNICAL FIELD

The present invention relates to a lever-type electrical connector.

BACKGROUND OF THE INVENTION

A conventional lever-type connector is described in JP-10-334987. In this connector, one of a pair of housings capable of mutually fitting together and being separated supports a lever in a manner whereby it can be pivoted. The other housing is provided with a cam pin which fits with a cam groove in the lever. When the two housings are to be fitted together, the two housings fit shallowly together while the lever is in a stand-by state. As a result, the cam pin enters an anterior edge position of the cam groove. From this state, the lever is pivoted to a fitting position. The fitting together of the cam groove and the cam pin draws the two housings together, these two housings then reaching a fitted state. If the lever is pivoted from this fitted state in the opposite direction, the fitted together cam groove and cam pin cause the two housings to move to the shallow fitting position. From this position, the cam pin can be removed from the anterior edge position of the cam groove, and the two housings can be separated.

When the lever is returned to the stand-by position and the two housings are to be separated, the cam pin remains fitted with the cam groove if the lever is misaligned from the stand-by position in the direction of the fitting position. Consequently, the two housings cannot be separated. As a result, smooth operation is impeded. The present invention has been developed after taking the above problem into consideration, and aims to present a lever-type connector wherein the separation operation of the two housings can be performed smoothly.

SUMMARY OF THE INVENTION

According to the invention there is provided a lever type electrical connector comprising a pair of mutually engeageable housings, one of the housings having a pivotable lever defining a cam track, and the other of the housings having a cam follower engageable with the cam track whereby pivoting of the lever from a stand-by position to a fitted position causes said cam follower to be drawn along said cam track, thereby drawing said housings together from shallow to deep engagement characterised in that said lever has identifying means adapted to permit visual confirmation of the respective position of said cam track and cam follower.

Such an arrangement permits the position of the cam follower to be viewed, and accordingly the lever can be placed in the correct position for smooth reception and disengagement of the cam follower and cam track.

Preferably a portion of the cam track is open, and a portion is occluded, the transition between open and occluded portions defining a visual marker for the cam follower. The cam follower is preferably occluded in the stand-by position of the lever.

The occluded portion may comprise a bridge linking both sides of said cam track, thus providing additional reinforcement. The bridge may completely occlude one end of the cam track, and the transition between open and occluded portions may be defined by a straight edge.

BRIEF DESCRIPTION OF THE DRAWINGS

Other features of the invention will be apparent from the following description of a preferred embodiment shown by way of example only in the accompanying drawings, in which.

DESCRIPTION OF PREFERRED EMBODIMENT

Figure 1:
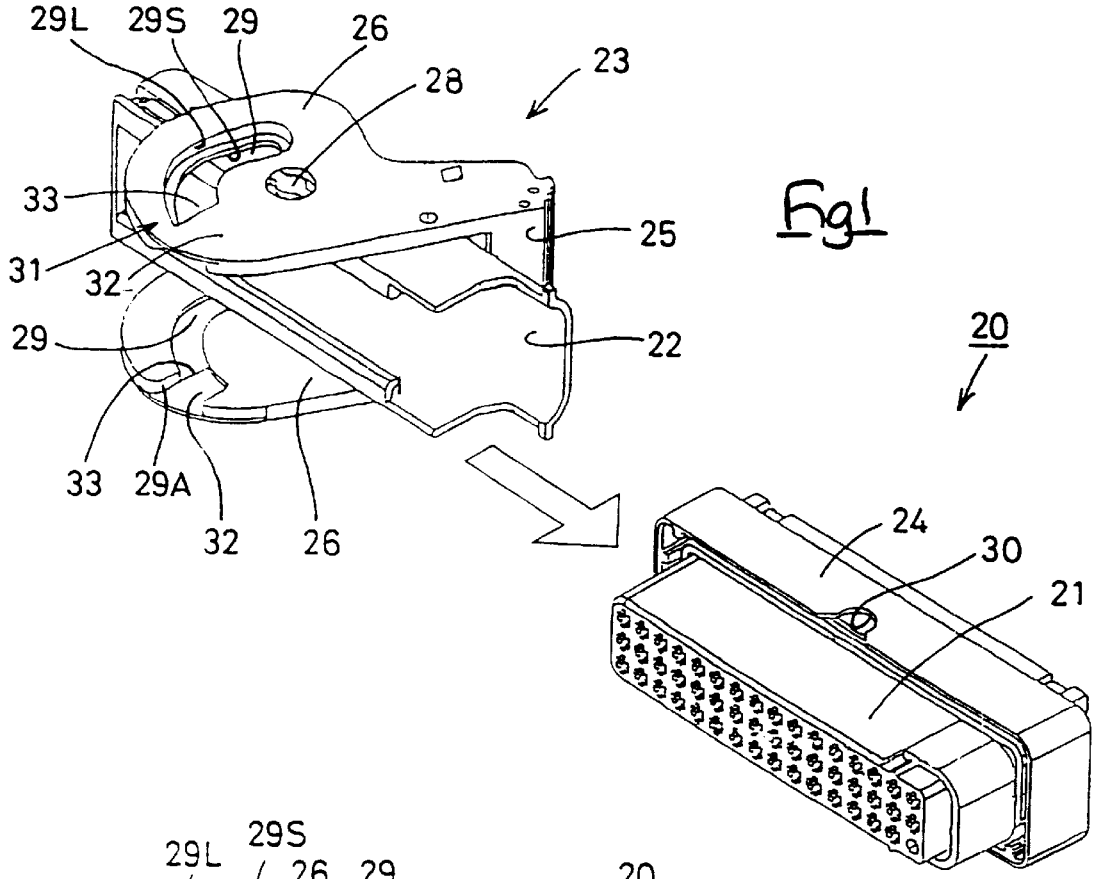
FIG. 1 is a disassembled diagonal view showing a lever housing of a first embodiment of the invention.
Figure 2:
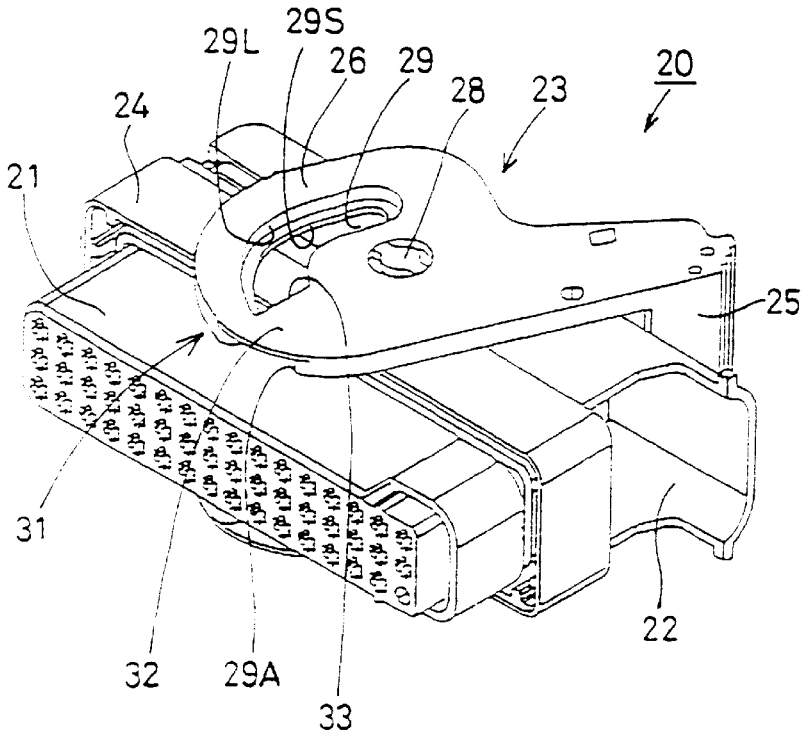
FIG. 2 is a diagonal view showing an attached state of the lever housing.
Figure 3:
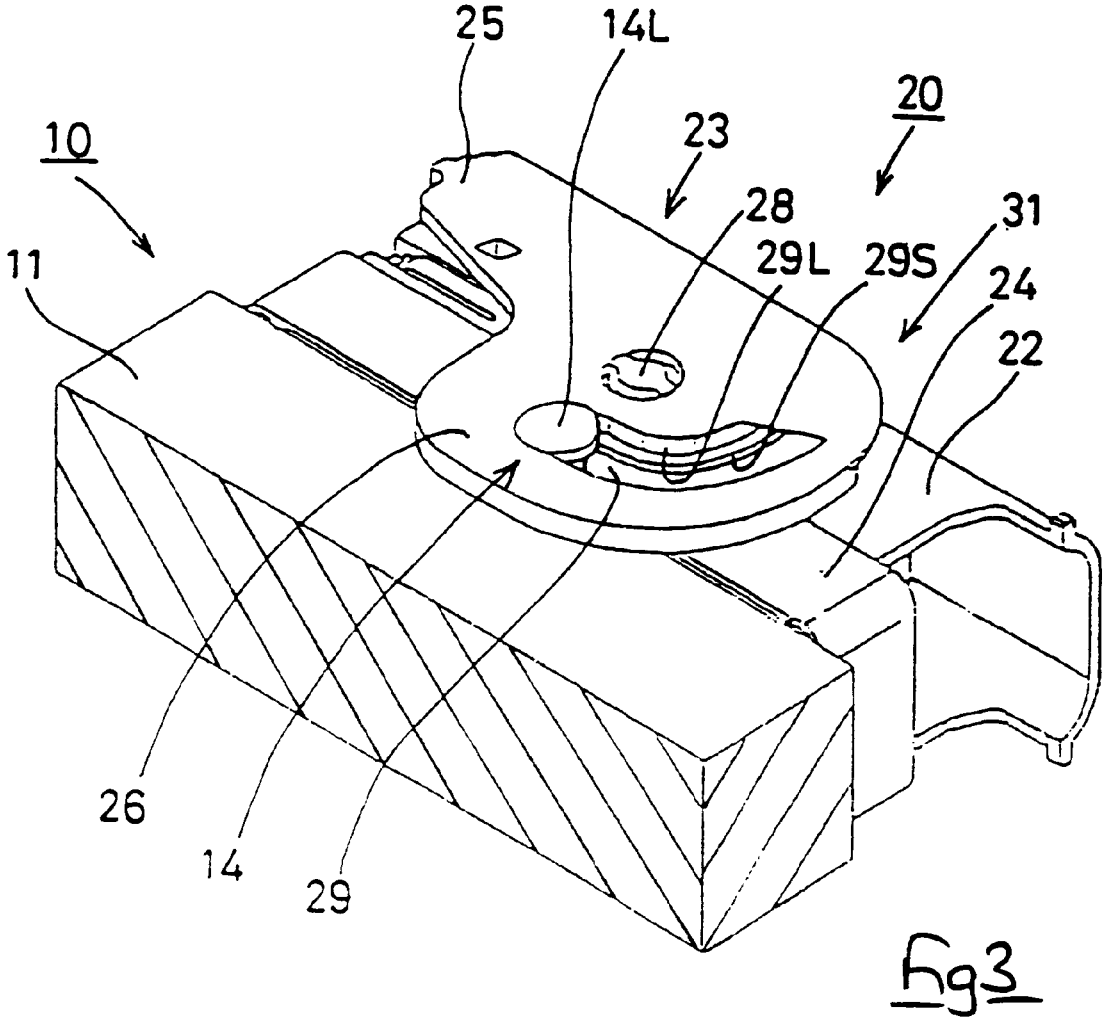
FIG. 3 is a diagonal view showing the lever housing in a fitted state with a machine housing.
Figure 4:
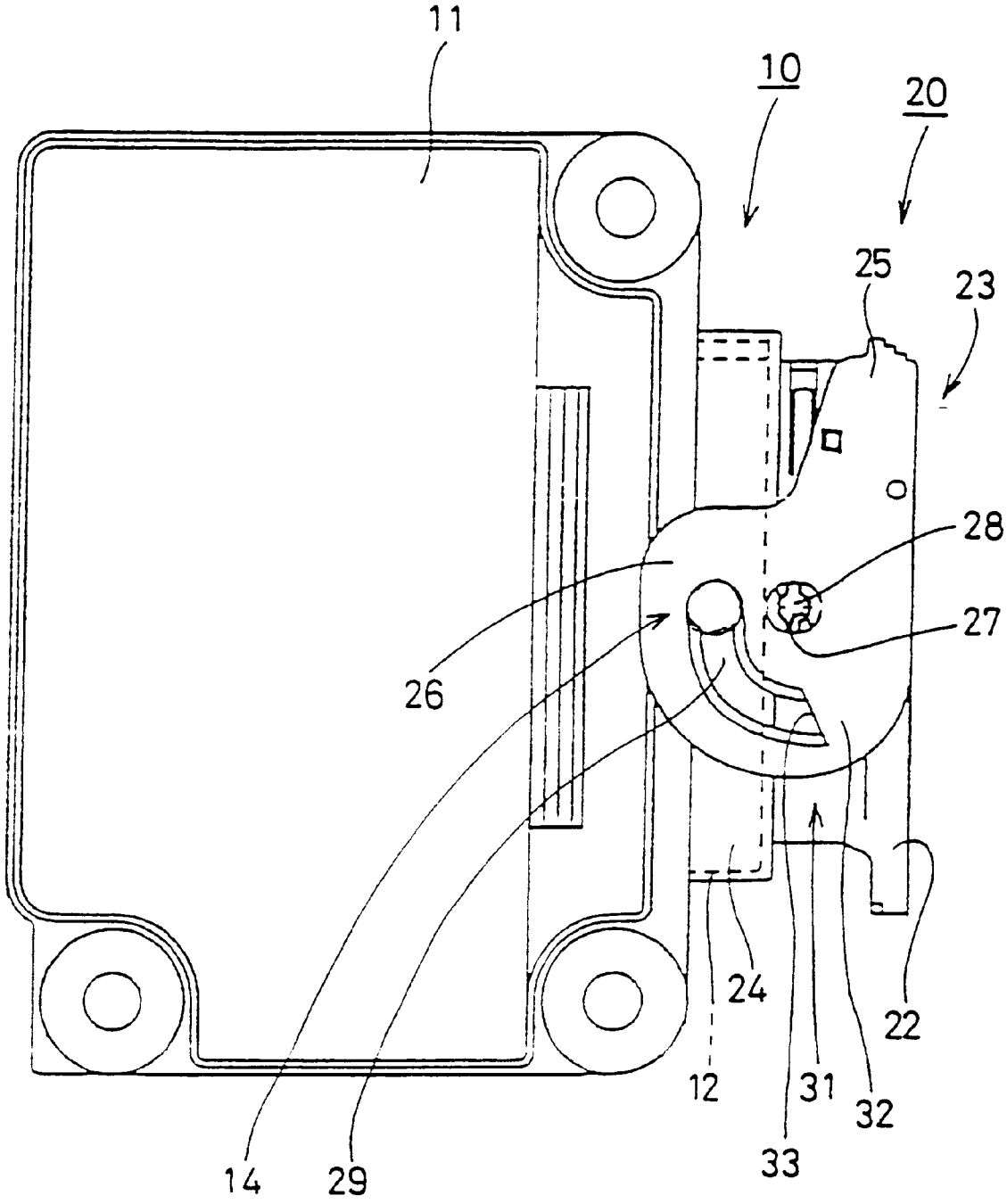
FIG. 4 is a plan view showing the lever housing in a fitted state with the machine housing.
Figure 6:
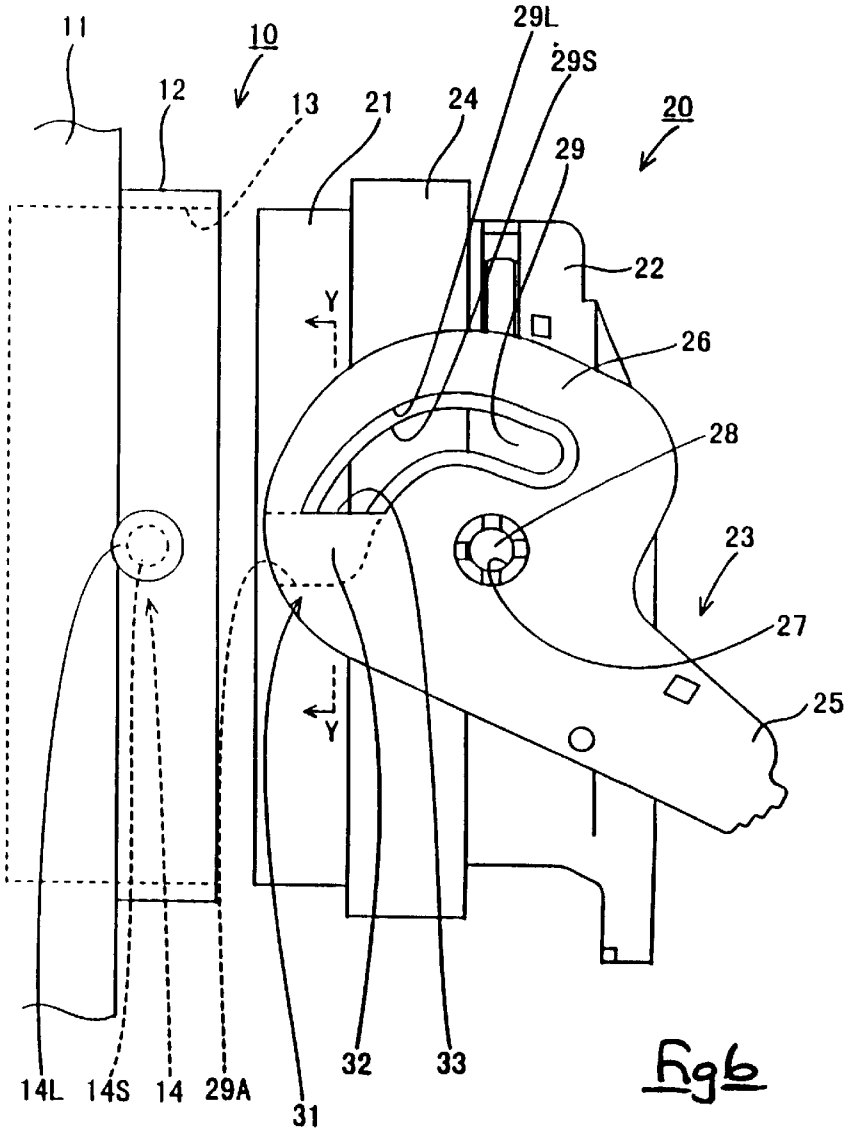
FIG. 6 is a partially enlarged plan view showing the lever housing in a separated state from the machine housing.
Figure 5:
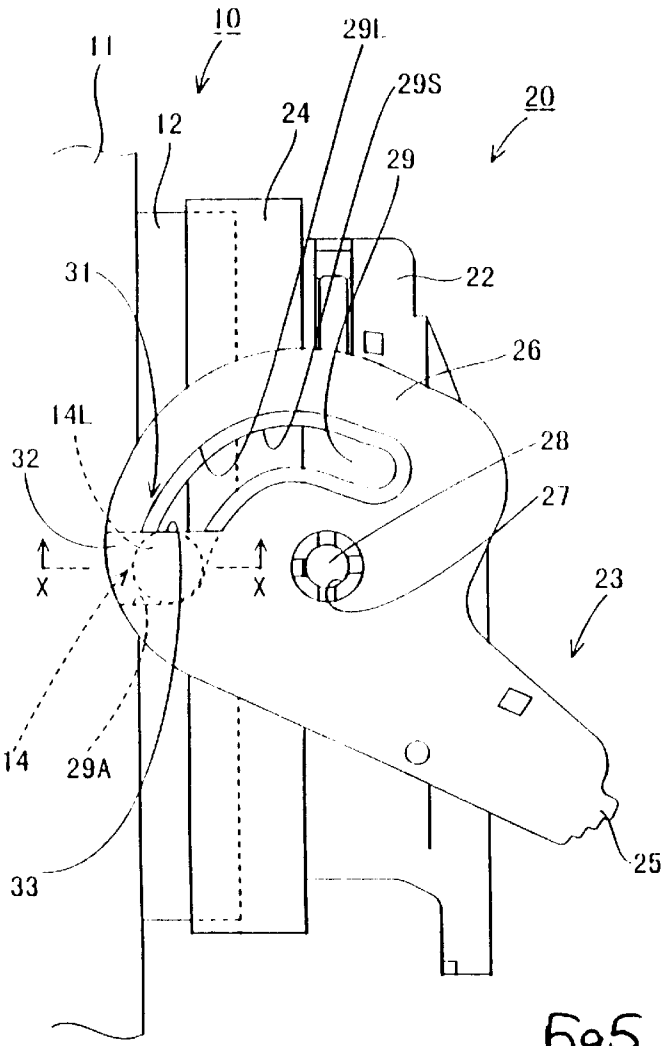
FIG. 5 is a partially enlarged plan view showing the lever housing and the machine housing in a shallowly fitted state.
Figure 8:
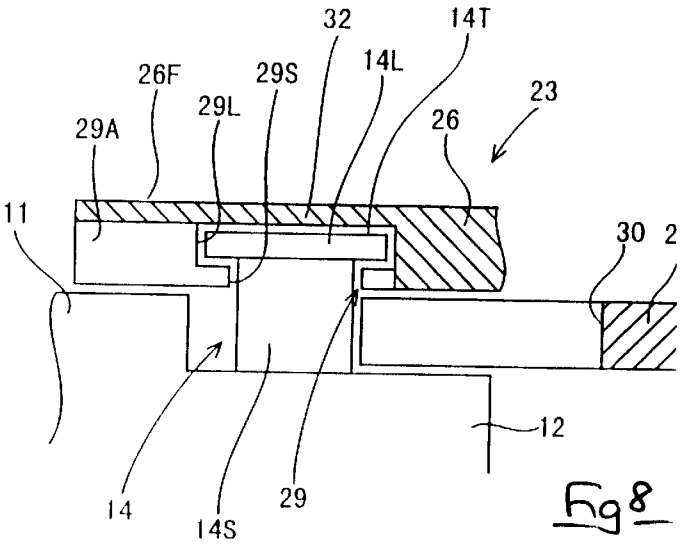
FIG. 8 is a cross-sectional view showing FIG. 5 along the line X—X.
Figure 9:
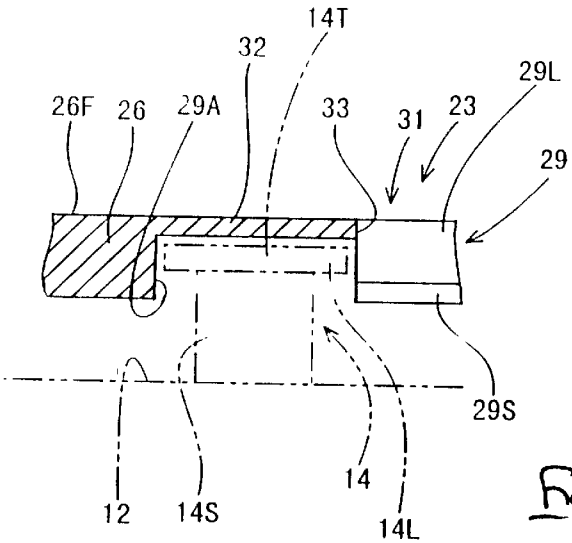
FIG. 9 is a cross-sectional view showing FIG. 6 along the line Y—Y.

An embodiment of the present invention is explained below with the help of FIGS. 1 to 9.

A connector is provided with two housings capable of mutually fitting together and separating. These consist of a lever housing 20 and a component housing 10.

The housing 10 is provided on an outer face of a component main body 11. A portion of an outer wall of the main body 11 has a concave shape, and an angular tubular hood 12 protrudes towards the exterior from a circumference edge of this concave portion (not shown). The concave portion and the hood 12 form a concave fitting member 13. Tips of a plurality of male terminal fittings (not shown) are in the interior of this concave fitting member 13. When the lever housing 20 is fitted with the concave fitting member 13, the male terminal fittings make contact with female terminal fittings of the lever housing 20.

The lever housing 20 consists of a housing main body 21 which houses the plurality of female terminal fittings (not shown) and fits with the concave fitting member 13, an electric wire cover 22 which attaches to the housing main body 21, and a lever 23 attached to the electric wire cover 22. A cylindrical fitting member 24 surrounds an outer circumference of the housing main body 21. When the two housings 10 and 20 are fitted together, this cylindrical fitting member 24 fits over an outer circumference of the hood 12.

The electric wires (not shown) protrude from a rear face of the housing main body 21. The electric wire cover 22 guides the electric wires along this rear face in a transverse direction so that they do not interfere with the lever 23. The lever 23 has an inverted U-shape and is attached to side faces of the electric wire cover 22. The lever 23 consists of a pair of plate-shaped arms 26 which extend from both edges of an operating member 25, and is capable of being pivoted from a stand-by position (see FIGS. 2, 5 and 6) to a fitting position (see FIGS. 3 and 4). Axle receiving holes 27 of the arms 26 fit with supporting axles 28 of the electric wire cover 22, thereby maintaining the lever 23 in this pivotable manner. Cam grooves 29 are formed in the arms 26, these cam grooves 29 fitting with cam pins 14 formed on outer faces of the hood 12 of the component housing 10. Anterior end portions of the cam grooves 29 open into side circumference faces of the arms 26. When the lever 23 is in the stand-by position, the position of anterior end openings 29A is such that the cam pins 14 will not interfere with the cam grooves 29 as the two housings 10 and 20 are being fitted together or separated, and smooth insertion or removal can be achieved. Furthermore, the cylindrical fitting member 24 is provided with recessed grooves 30, thereby preventing interference between the cam pins 14 and the cylindrical fitting member 24 when the cam pins 14 are inserted into the cam grooves 29.

When the two housings 10 and 20 are to be fitted together, the lever housing 20 is fitted shallowly together with the component housing 10 while the lever 23 is in the stand-by state. The cam pins 14 are inserted into anterior edge positions of the cam grooves 29 (see FIG. 5). From this state, the lever 23 is rotated to the fitting position. Thereupon, the fitting together of the cam grooves 29 and cam pins 14 draws the lever housing 20 into the component housing 10, and a correctly fitted state is achieved (see FIG. 4). Further, if the lever 23 is rotated back to the stand-by position from this correctly fitted state, the fitting together of the cam grooves 29 and the cam pins 14 pushes the lever housing 20 out of the concave fitting member 13 of the component housing 10. The two housings 10 and 20 thereby return to their shallowly fitted state. The cam pins 14 fit with the anterior end openings 29A of the cam groove 29. Consequently, if the two housings 10 and 20 are pulled apart from this state, the cam pins 14 are removed from the cam groove 29, and the two housings 10 and 20 are separated (see FIG. 6).

Figure 7:
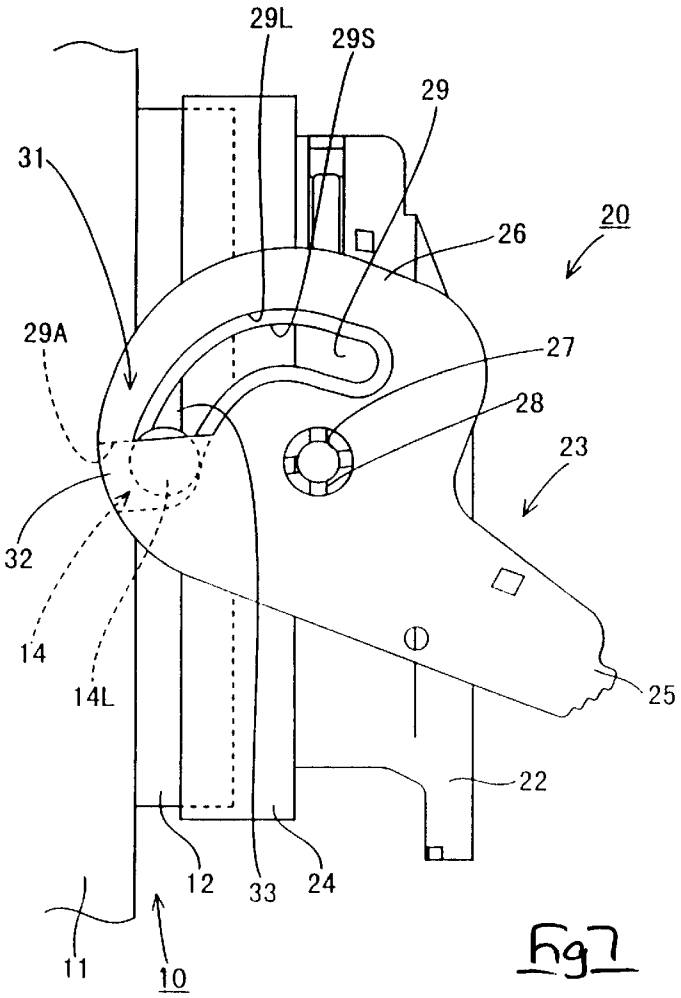
FIG. 7 is a partially enlarged plan view showing the lever housing and the machine housing in a shallowly fitted state and a lever being in a state whereby it is misaligned from a stand-by position in the direction of a fitting position.

If, as shown in FIG. 7, the lever is not returned to the correct stand-by position when the two housings 10 and 20 are to be separated, the cam pins 14 interfere with side edges of the cam grooves 29, thereby hindering the separation of the two housings 10 and 20. However, the present embodiment deals with this problem. The lever 23 is provided with an identifying means 31 which allows the positional relationship between the lever 23 and the cam pins 14, relative to direction of rotation of the lever 23, to be identified visually when the two housings 10 and 20 are in the shallowly fitted state. The configuration of this identifying means 31 is described below.

The cam grooves 29 pass from inner side faces of the arms 26 to outer side faces thereof, these cam grooves 29 extending along almost the entire range of arms 26, with the exception of anterior ends thereof. If the cam grooves 29 are viewed cross-sectionally from approximately a right angle to their direction of rotation, the groove width of the cam grooves 29 appears step-shaped, outer side faces thereto being broader than inner side faces. Each cam pin 14 consists of a small diameter member 14S and a large diameter member 14L. The small diameter member 14S fits with a narrow width member 29S of each cam groove 29, and the large diameter member 14L fits with a broad width member 29L of each groove 29. The large diameter members 14L make contact with an axial direction with outer faces of the narrow width members 29S, the arms 26 thereby preventing the cam pins 14 from moving outwards relative to the axial direction, and thereby maintaining the fitted state of the cam pins 14 and the cam grooves 29.

A protruding end face 14T of each cam pin 14 is located at a position inwards from an outer face 26F of each arm 26 (see FIGS. 8 and 9), a gap thereby occurring between the two faces 14T and 26F. The identifying means 31 is provided by means of this gap. The identifying means 31 consists of a plate-like covering member 32 and an exposing aperture 33. The covering member 32 is provided at the anterior end openings 29A which open into the outer circumference faces of the arms 26 of the cam groove 29. The aperture 33 adjoins, in the direction of rotation of the lever 23, the covering member 32. The covering member 32 is thinner than the gap between the outer face 26F of the arm 26 and the protruding end face 14T of the cam pin 14. An outer face of the covering member 32 forms a unified face with the outer face 26F of each arm 26, and the covering member 32 has a bridge shape which joins both side edges of the anterior end openings 29A of the cam grooves 29. Further, the configuration of the covering member 32 is such that it entirely covers the cam pins 14 (see FIG. 5) only when the lever 23 is in the correct stand-by position (when the two housings 10 and 20 are to be separated from their shallowly fitted state, this is the state whereby the cam pins 14 pass the anterior end openings 29A without interfering with the groove ends of the cam grooves 29 and can be removed to the exterior of the arms 26). The aperture 33 is formed on a portion of the area in the cam grooves 29 which opens towards the outer faces 26F of the arms 26. If the lever 23 is slightly misaligned from the correct stand-by position in the direction of the fitting position, the aperture 33 allows a portion of the cam pin 14, which was entirely covered by the covering member 32, to protrude and be visible (see FIG. 7).

Next, the operation of the present embodiment is explained.

If the lever 23 is returned to the correct stand-by position when it is rotated from the fitted state to the stand-by position, and the two housings 10 and 20 come to be in the shallowly fitted state, the cam pins 14 are entirely covered by the covering members 32. However, if the lever 23 is misaligned from the correct stand-by position in the direction of the fitting position, a portion or the entirety of the cam pins 14 protrude and are visible. That is, the identifying means 31 make it possible to ascertain whether the lever 23 has been returned to the correct stand-by position by visually examining the positional relationship of the cam pins 14 and the lever 23. Consequently, the lever 23 can reliably be pivoted to the correct stand-by position when the two housings 10 and 20 are to be separated from the shallowly fitted state, and the cam pins 14 are prevented from interfering with the groove ends of the anterior end openings 29A of the cam grooves 29.

Furthermore, the covering member 32 has a bridge shape which joins both side edges of the cam grooves 29. Consequently, the covering member 32 also performs a strengthening function and thereby prevents a change of shape of the lever 23, which may result in the opening width of the cam grooves 29 becoming wider or narrower. Moreover, in the case of a configuration where the aperture constituting the identifying means has a small opening and the cam grooves do not protrude in their entirety to the outer side faces of the arms, the lever may be incorrectly believed to be in the correct stand-by position when the lever has been displaced from the correct stand-by position and the exposing member should have but does not expose the cam pins. However, in the present embodiment, the cam grooves 29 open almost entirely into the outer faces 26F of the arms 26 and the aperture 33 is joined to the opening space of the cam grooves 29. Consequently, when the lever 23 is not in the correct stand-by position the cam pins 14 will definitely protrude so as to be visible within the cam grooves 29. As a result, it is possible to reliably identify whether the lever 23 is in the correct stand-by position.

Furthermore, the present invention is not limited to the embodiments described above with the aid of figures. For example, the possibilities described below also lie within the technical range of the present invention. In addition, the present invention may be embodies in various other ways without deviating from the scope thereof.

(1) In the above embodiment, the identifying means has a configuration whereby the cam pins are entirely covered when the lever is in the correct stand-by position, and a portion of the cam pin is visible when the lever is slightly misaligned towards the fitting direction from the correct stand-by position. However, according to the present invention, this configuration may equally well be the opposite of the above embodiment, with the entirety of the cam pins protruding and being visible when the lever is in the correct stand-by position, and a portion of the cam pins being covered when the lever is misaligned from the correct stand-by position. Moreover, an indicator with calibrations or the like may be provided on the outer face of the lever, this allowing one to judge the location of the lever relative to the location of the cam pins.

(2) The above embodiment describes a lever-type connector used for an apparatus, whereby the housing which does not have the lever provided thereon is formed in a unified fashion with the electrical component. However, the present invention is also suitable for a lever-type connector not used for a component, such as a wire-to-wire lever-type connector.

(3) In the above embodiment, the covering member has a bridge shape which joins both side edges of the cam grooves. However, according to the present invention, the covering member may equally well have a cantilevered shape, extending from only one of the side edges of the cam grooves.

What is claimed is:

1. A lever type electrical connector comprising a pair of mutually engageable housings, one of the housings having a cam follower, and the other of the housings having a pivotable lever defining a cam track, said cam track being the path along which the cam follower travels as the lever is pivoted from a stand-by position to a fitted position, whereby pivoting of the lever from the stand-by position to the fitted position causes said cam follower to be drawn along said cam track, thereby drawing said housings together from shallow to deep engagement, wherein said lever has identifying means adapted to permit visual confirmation of the respective position of said cam track and cam follower in the stand-by position, said identifying means permitting at least a portion of said cam follower to be visible and at least a portion of cam follower to be covered when said cam follower is in said cam track and said lever is slightly misaligned from said stand-by position.

2. A connector according to claim 1 wherein said identifying means comprises an open portion of said cam track open to the exterior of said lever and an occluded portion of said cam track which is occluded to the exterior of said lever, said cam follower being viewable through the open portion.

3. A connector acording to claim 2 wherein said cam follower is covered by the occluded portion in the stand-by position of said lever only.

4. A connector according to claim 3 wherein said cam track has opposite edges and said occluded portion comprises a bridge joining said opposite edges.

5. A connector according to claim 4 wherein said occluded portion renders blind one end of said cam track.

6. A connector according to claim 5 wherein a straight edge defines the transition between said open portion and said occluded portion.

7. A connector according to claim 6 wherein said straight edge coincides with the periphery of said cam follower.

8. A connector according to claim 7 wherein the periphery of said cam follower is circular.

* * * * *